US005630510A

United States Patent [19]

Lamb, Jr. et al.

[11] Patent Number: 5,630,510

[45] Date of Patent: May 20, 1997

[54] PACKAGING AND LOADING SOLID INK NUGGETS FOR INK JET APPARATUS

[75] Inventors: Walter C. Lamb, Jr., N. Billerica; Leonard E. Westgate, Chelmsford, both of Mass.

[73] Assignee: Polaroid Corporation, Cambridge, Mass.

[21] Appl. No.: 524,534

[22] Filed: Sep. 7, 1995

[51] Int. Cl.[6] ..... B65D 83/00

[52] U.S. Cl. ..... 206/497; 53/442; 206/525; 206/804; 346/99; 347/88

[58] Field of Search ..... 206/497, 525, 206/804, 815; 53/442; 346/99; 347/86, 88

[56] References Cited

U.S. PATENT DOCUMENTS

| | | | |
|---|---|---|---|
| 1,856,286 | 5/1932 | Neff . | |
| 2,979,871 | 4/1961 | Kieckhefer | 53/3 |
| 3,131,810 | 5/1964 | Dreyfus | 206/46 |
| 3,152,745 | 10/1964 | Rumsey, Jr. | 229/87 |
| 3,272,328 | 9/1966 | Krzyzanowski | 206/65 |
| 3,369,655 | 2/1968 | Harrison | 206/56 |
| 3,403,840 | 10/1968 | Mathes | 229/51 |
| 3,546,828 | 12/1970 | Lundberg | 53/24 |
| 3,566,752 | 3/1971 | Dreher | 93/1 |
| 3,578,239 | 5/1971 | Perlman | 229/53 |
| 3,627,115 | 12/1971 | Samalon | 206/497 |
| 3,641,732 | 2/1972 | Fujio | 53/14 |
| 3,666,166 | 5/1972 | Freakes | 229/23 AB |
| 3,668,061 | 6/1972 | Forman | 161/175 |
| 3,679,048 | 7/1972 | Fujio | 206/46 R |
| 3,788,462 | 1/1974 | Meincer | 206/65 S |
| 3,918,584 | 11/1975 | Richardson | 206/497 |
| 4,005,777 | 2/1977 | Marantz | 206/497 |
| 4,139,099 | 2/1979 | Daly et al. | 206/575 |
| 4,328,896 | 5/1982 | Behne | 206/497 |
| 4,596,330 | 6/1986 | Benno | 206/427 |
| 4,627,223 | 12/1986 | Janhonen | 53/449 |
| 4,631,557 | 12/1986 | Cooke et al. | 346/140 R |
| 4,823,146 | 4/1989 | Cooke et al. | 346/1.1 |
| 4,864,330 | 9/1989 | Creagh et al. | 346/140 R |
| 5,003,322 | 3/1991 | Creagh et al. | 346/1.1 |
| 5,038,157 | 8/1991 | Howard | 346/140 R |
| 5,115,618 | 5/1992 | Janhonen | 53/449 |
| 5,129,518 | 7/1992 | Tanaka et al. | 206/497 |
| 5,172,135 | 12/1992 | Creagh et al. | 346/1.1 |
| 5,223,860 | 6/1993 | Loofbourow et al. | 346/140 R |
| 5,276,468 | 1/1994 | Deur et al. | 346/140 R |
| 5,323,896 | 6/1994 | Jones | 206/223 |
| 5,375,718 | 12/1994 | Honma et al. | 206/497 |
| 5,413,412 | 5/1995 | Odabashian | 383/208 |
| 5,562,206 | 10/1996 | Keller | 206/804 |

*Primary Examiner*—Jimmy G. Foster
*Attorney, Agent, or Firm*—Leslie Payne

[57] ABSTRACT

A solid ink jet nugget is contained in a first sleeve having opposite open ends and a flap at one open end movable into the sleeve towards the other open end. A second sleeve is placed about the first sleeve with its opposite ends directed generally at right angles to the direction of the open ends of the first sleeve. The second sleeve is then heat-shrunk on the first sleeve to close the open ends of the first sleeve. Prior to loading into an ink jet apparatus, the second sleeve is removed and the flap is pushed into the first sleeve against the nugget to discharge the nugget from the open end and into the ink jet apparatus.

15 Claims, 2 Drawing Sheets

PACKAGING AND LOADING SOLID INK NUGGETS FOR INK JET APPARATUS

BACKGROUND OF INVENTION

The present invention generally relates to ink jet apparatus such as ink jet printers or proofers. More specifically the present invention relates to novel methods and apparatus for packaging solid ink jet nuggets, also termed blocks, cartridges, etc., and for loading them into ink jet apparatus. Ink for conventional ink jet apparatus is initially supplied to the apparatus in solid block form to be melted prior to ejection through orifices. If the solid ink nuggets are not handled properly they can become contaminated. In addition, during loading into ink jet apparatus partial melting of the nugget can inhibit removal from its packaging. Also, the risk of splashing hot ink melt presents a certain danger.

An object of the present invention is to provide novel methods and packaging for handling solid ink jet nuggets and for loading them into ink jet apparatus such as printers and proofers. Included herein are such methods and apparatus that address and alleviate if not correct the above noted problems existing in the particular art.

A further object of the present invention is to provide novel methods of packaging and novel packaging for solid ink jet nuggets which will significantly reduce if not avoid contamination of the nugget while at the same time providing a relatively quick and easy as well as safe method of loading a nugget into ink jet apparatus.

A still further object of the present invention is to provide novel methods and packaging for solid ink jet nuggets that may be economically employed with new or conventional ink jet apparatus without requiring modification of the apparatus.

Another object of the present invention is to provide novel packaging and method of packaging and handling ink jet nuggets in an economical manner employing readily available materials and requiring no special skills.

SUMMARY OF PREFERRED FORM OF THE INVENTION

The present invention is preferably carried out by containing the ink jet nugget in a first sleeve having opposite open ends and a flap at one open end movable into the sleeve towards the other open end. A second sleeve is placed on the first sleeve with its opposite open ends directed generally at right angles to the direction of the open ends of the first sleeve. The second sleeve is then heat-shrunk on the first sleeve to close the open ends of the first sleeve. Prior to loading into an ink jet apparatus, the second sleeve is removed and the flap is pushed into the first sleeve against the nugget to discharge the nugget from the open end and into the ink jet apparatus.

DRAWINGS

Other objects of the present invention will become apparent from the more detailed description of the invention appearing below taken in conjunction with the attached drawings in which.

DETAILED DESCRIPTION

Figure 1:
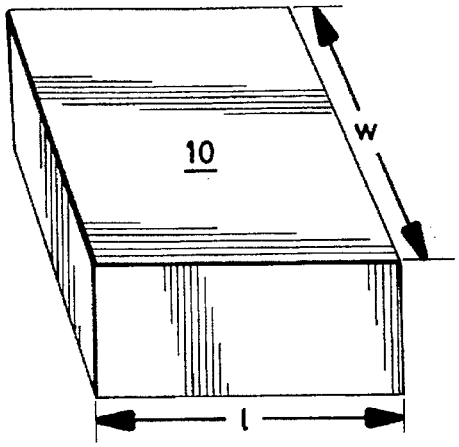
FIG. 1 is a perspective view of an ink nugget that may be packaged, handled and loaded into an ink jet apparatus in accordance with the present invention.
Figure 6:
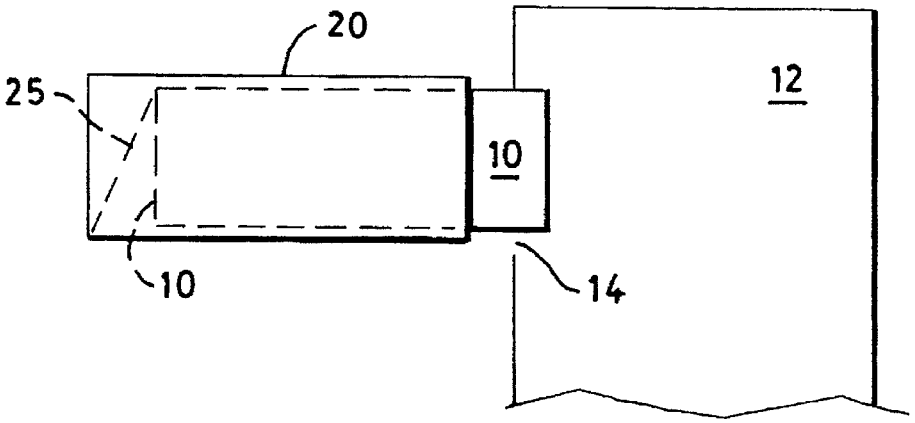
FIG. 6 is a side elevational view of the package with the second sleeve removed and illustrating loading of the nugget into an ink jet apparatus.

Referring now to the drawings in detail there is shown for illustrative purposes only methods and packaging for handling and loading solid ink jet nuggets for ink jet apparatus, a sample nugget 10 being shown in FIG. 1 and ink jet apparatus 12 being schematically shown in FIG. 6. Nugget 10 may be a conventional solid block of ink having grooves or other features (not shown) for matching with corresponding features in a receptacle in the apparatus 12 for the particular type or color of ink.

Figure 2:
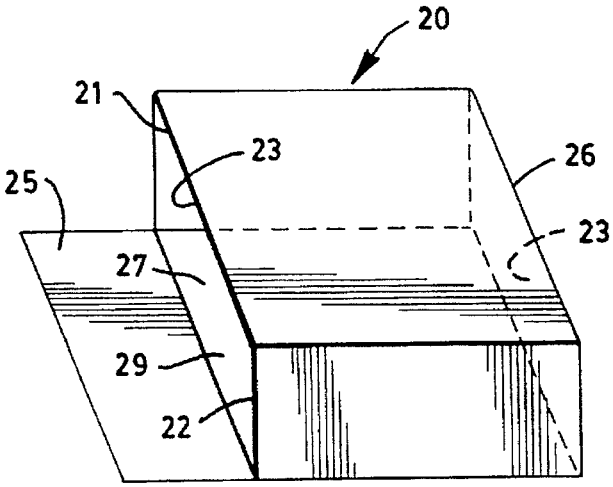
FIG. 2 is a perspective view of a preferred sleeve for receiving the ink nugget of FIG. 1.

In accordance with the present invention the nugget 10 is packaged with a first sleeve generally designated 20 in FIG. 2 preferably formed from flat planar or sheet plastic material having fold lines defining rectangular panels or walls erectable into a generally rectangular box-like sleeve having opposite top and bottom walls 26 and 27 (or vice versa) and side walls 21 and 22 with opposite open ends 23. Hinged at 29 to wall 27 at an open end is a flap 25 that is movable into the sleeve 20 for a purpose to be described. Flap 25 has a height generally equal or slightly less than the depth of the sleeve 20.

Figure 7:
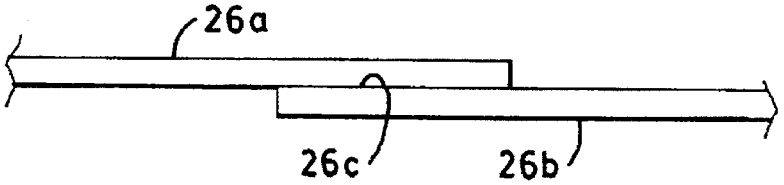
FIG. 7 is a cross-sectional view of the top wall of the sleeve shown in FIG. 2 showing its overlapped construction.

Nugget 10 may be received in sleeve 20 through either open end 23 or as an alternative it may be placed on bottom wall 27 while the side walls 21 and 22 and top wall 26 lay flat in developed position; and then the side walls 21, 22 and top wall 26 are erected and wrapped about the nugget 10. Further in this regard, although FIG. 2 shows the top wall 26 as one uni-planar piece, it is preferred that it be made of overlapping pieces **26*a* and 26*b* that are bonded together 26*c* as shown in FIG. 7. In this way all of the walls of sleeve 20 are integral with each other. It is preferred that the sleeve 20 be made of a suitable flexible but semi-rigid thin plastic material, such as PVC with a thickness of 0.010 to 0.015 inches that is also transparent and which does not adhere to the nugget. The dimensions of the space defined by sleeve 20 in its erected state shown in FIG. 2** should be loosely fit about the nugget so that the width and height dimensions are slightly larger and the length is less to allow the nugget to project therefrom for aligning with the opening in the ink reservoir. In one embodiment the sleeve may have a length of one and nine-sixteenth inches (1 9/16"), a width w of one and nine-sixteenth inches (1 9/16") and a height or depth of thirteen-sixteenths of an inch (13/16").

Figure 3:
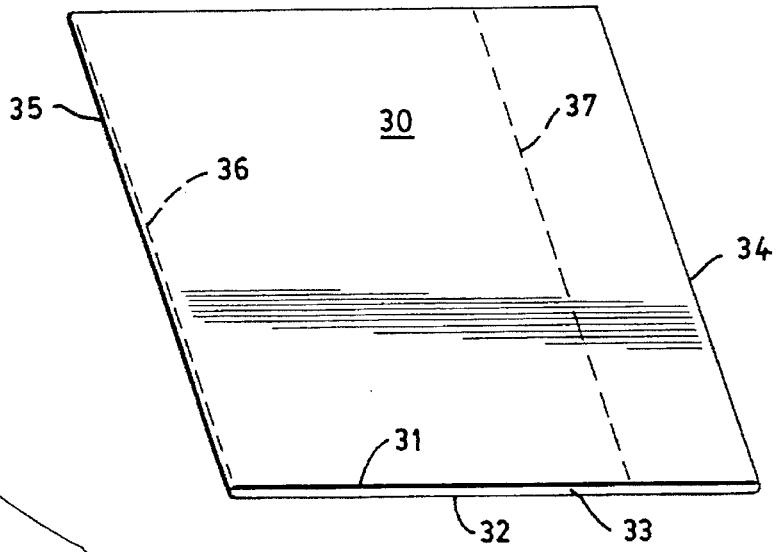
FIG. 3 is a perspective view of a second sleeve for receiving the nugget and first sleeve, the second sleeve being shown in flat condition.

In furtherance of the present invention, the sleeve 20 with the nugget 10 received therein is then placed in a sleeve 30 shown in FIG. 3 in its normal or closed condition where it lies flat.

Figure 4:
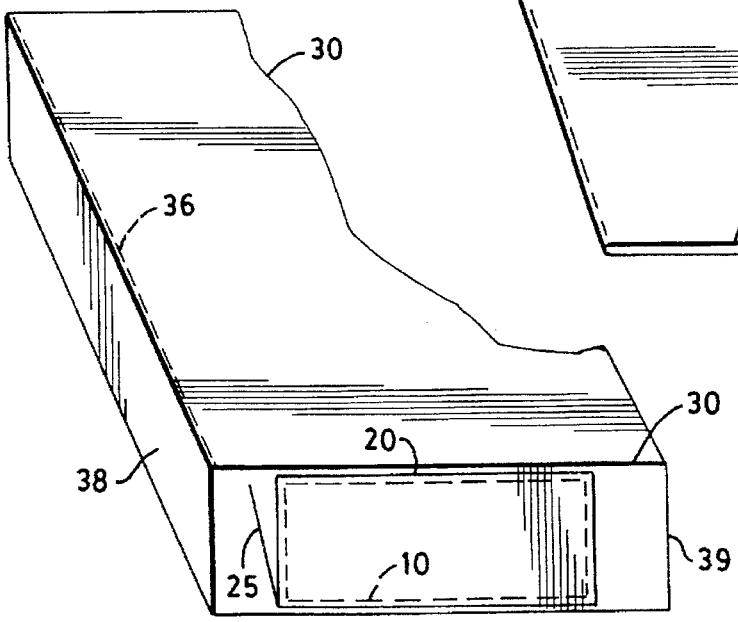
FIG. 4 is a perspective view partially broken away, illustrating the second sleeve in open condition initially receiving the first sleeve with the nugget therein.
Figure 5:
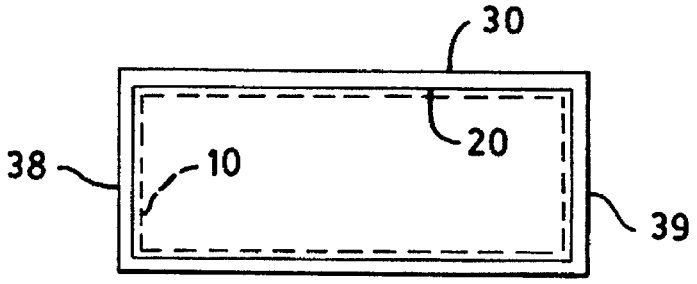
FIG. 5 is an end view of the assembly of FIG. 4 but shown after the second sleeve has been heat-shrunk to close the openings of the first sleeve.

Sleeve 30 has opposite flat walls 31 and 32, opposite closed sides 34, 35 and opposite open ends 33 for receiving the nugget 10 while wrapped in sleeve 20. It should be noted that sleeve 20 with nugget 10 received therein is placed into sleeve 30 with the open ends 33 of sleeve 30 directed at right angles to the direction of the open ends 23 of sleeve 20. In this way the opposite side portions 38, 39 of sleeve 30 will close the open ends 23 of the sleeve 20 when the sleeve 30 is subsequently heat-shrunk in accordance with the next step of the present invention. Sleeve 30 is therefore made of any suitable heat-shrinkable plastic, flexible film material, such as heat shrinkable PVC that does not readily adhere to the ink nugget and of larger length and width dimensions than the sleeve 20 as illustrated in FIG. 4. It is desirable that the PVC selected FIG. 5 illustrates the package after sleeve 30 has been heat-shrunk. The sleeve 30 can be formed with a perforation 37 running along its longitudinal extent to facilitate a user opening the package. Although not shown there can be provided a tear strip or the like for facilitating opening of the sleeve 30. The perforation also is arranged to extend across a solid surface panel of the inner tube to prevent dust from entering.

In use the package shown in FIG. 5 may be stored, transported or handled in this condition until it is to be used. To load the ink jet apparatus 12 with nugget 10, the outer sleeve 30 is removed from the sleeve 20 to open end 23 of sleeve 20. Removal of outer sleeve 30 is facilitated by perforated or score lines 36 formed along one side of the sleeve 30 as best shown in FIG. 3.

Referring to FIG. 6, the opening 23 of sleeve 20 is then aligned with an opening 14 in the ink jet apparatus 12 and the nugget 10 is pushed from the sleeve 10 into the opening 14 by pressing flap 25 inwardly against the nugget.

It will be seen from the above that the present invention provides a unique but inexpensive packaging and packaging method by which nuggets or blocks of solid "ink-jet" ink may be safely and securely stored and loaded against contamination or splash-back. Additionally the nugget may be easily and quickly discharged from its packaging and into the ink jet apparatus without any special skill.

Although preferred embodiments of the present invention have been shown and described, various modifications of the invention will become readily apparent to those of ordinary skill in the art without departing from the scope of the invention defined in the appended claims.

What is claimed is:

1. A package containing a solid ink nugget for ink jet apparatus, the package including an inner sleeve containing the nugget and having opposite open ends and a flap at one of said ends movable towards the other open end, a second sleeve receiving the first sleeve and closing said open ends of the first sleeve, said second sleeve being removable from the first sleeve to expose said flap and open said other open end to allow the nugget to be pushed through said other open end upon pushing the flap in the first sleeve.

2. The package defined in claim 1 wherein said inner sleeve has a rectangular cross-section and is made from foldable opposite top and bottom and side flat panels, and said flap is integral and hinged to one of the top and bottom panels.

3. The package defined in claim 1 wherein said second sleeve is heat-shrunk on said first sleeve.

4. The package defined in claim 2 wherein said inner sleeve is made from semi-rigid sheet plastic material and said outer sleeve is made from a heat-shrinkable plastic sheet material.

5. The package defined in claim 4 wherein said first and second sleeves are transparent.

6. The package defined in claim 1 wherein said second sleeve has opposite open ends facing a direction generally at right angles to an axis extending between the open ends of said first sleeve.

7. A solid ink nugget package for ink jet apparatus, the package having opposite top and bottom walls and side walls enclosing the nugget, said package having opposite open ends and a flap hinged to one of said walls at one of said open ends and movable towards the other open end to push the nugget through the other open end to allow the nugget to project and thereby guide insertion into the ink reservoir.

8. The package defined in claim 7 wherein said walls are made from sheet material and are hinged to each other to be movable from collapsed to erect position.

9. The package defined in claim 8 wherein said walls are made from transparent plastic sheet material.

10. The package defined in claim 6 wherein said second sleeve has a perforation extending along a portion to facilitate opening of the package wherein said perforation extends across a solid surface of said inner sleeve.

11. A method of handling a solid ink nugget and loading it into ink jet apparatus, the method comprising the steps of: packaging the nugget in a sleeve having opposite open ends with one end having a flap movable in the sleeve towards the other open end, aligning the nugget projecting from the other open end with an opening in the ink jet apparatus and pushing the flap into the sleeve to engage and push the ink nugget through the other open end and into the opening in the ink jet apparatus.

12. The method defined in claim 11 wherein said other open end is closed with a removable closure which is removed prior to pushing the nugget through said other end.

13. The method defined in claim 12 wherein said closure is heat-shrunk on said sleeve.

14. The method defined in claim 13 wherein said closure is included in a second sleeve which receives the first defined sleeve with the sleeves extending generally at right angles to each other.

15. A method of packaging an article comprising the steps of containing the article in a sleeve having opposite open ends with a flap at one end movable towards the other end, placing the sleeve in a second sleeve having opposite open ends directed generally at right angles to the direction of the open ends of said first sleeve, and heat shrinking the second sleeve on the first sleeve to close said other open end of said first sleeve until such time as it is desired to remove the article whereupon the second sleeve may be removed to open said other end of said first sleeve and the flap may be pushed into the sleeve to push the article from said open end of said first sleeve.

* * * * *